United States Patent [19]

Althouse et al.

[11] Patent Number: 4,659,163

[45] Date of Patent: Apr. 21, 1987

[54] FILTERED SHIELDED CONNECTOR ASSEMBLY

[75] Inventors: Rickie M. Althouse, Harrisburg; Nicholas L. Gurreri, III, York; John P. Kling, Mount Joy, all of Pa.

[73] Assignee: AMP Incorporated, Harrisburg, Pa.

[21] Appl. No.: 849,360

[22] Filed: Apr. 7, 1986

Related U.S. Application Data

[63] Continuation of Ser. No. 620,362, Jun. 13, 1984, abandoned.

[51] Int. Cl.[4] ..... H01R 13/648; H01R 13/66

[52] U.S. Cl. ..... 339/143 R; 339/147 R

[58] Field of Search ..... 339/138, 139 R, 139 C, 339/141, 143 R, 147 R, 147 P; 333/181-185

[56] References Cited

U.S. PATENT DOCUMENTS

| | | | |
|---|---|---|---|
| 3,961,294 | 6/1976 | Hollyday | 339/143 R |
| 4,020,430 | 4/1977 | Vander Heyden | 339/147 R |
| 4,053,199 | 10/1977 | Hollyday et al. | 339/147 R |
| 4,070,084 | 1/1978 | Hutchison | 339/176 M |
| 4,106,839 | 8/1978 | Cooper | 339/143 R |
| 4,215,326 | 7/1980 | Hollyday | 339/147 R |
| 4,337,989 | 7/1982 | Asick et al. | 339/143 R |
| 4,371,226 | 2/1983 | Brancaleone | 339/143 R |
| 4,386,814 | 6/1983 | Asick | 339/143 R |
| 4,401,355 | 8/1983 | Young | 339/147 R |
| 4,451,107 | 5/1984 | Dola et al. | 339/143 R |
| 4,457,575 | 7/1984 | Davis et al. | 339/143 R |
| 4,497,530 | 2/1985 | Shannon | 339/186 M |
| 4,516,815 | 5/1985 | Venable et al. | 339/143 R |
| 4,519,665 | 5/1985 | Althouse et al. | 339/147 R |

FOREIGN PATENT DOCUMENTS

| | | | |
|---|---|---|---|
| 2613907 | 10/1977 | Fed. Rep. of Germany | 339/143 R |

*Primary Examiner*—Gil Weidenfeld
*Assistant Examiner*—Gary F. Paumen
*Attorney, Agent, or Firm*—Eric J. Groen; Katherine A. Nelson

[57] ABSTRACT

A filtered shielded connector assembly is comprised of an insulating housing member having one or more connector receiving cavities therein, a plurality of pin terminals, filtering means and shielding means. The shielding means is comprised of two metal members, a front face plate and a shell, said plate and shell being dimensioned to surround said housing member. One end of each terminal extends through apertures in the housing and into the connector receiving cavities, the second end of each terminal extends rearwardly from the housing, through the filtering means and through the shielding shell.

14 Claims, 9 Drawing Figures

FILTERED SHIELDED CONNECTOR ASSEMBLY

This application is a continuation of application Ser. No. 620,362 filed June 13, 1984, now abandoned.

FIELD OF THE INVENTION

The present invention relates to an electrical connector assembly and in particular to a filtered electromagnetic shielded electrical connector assembly.

BACKGROUND OF THE INVENTION

Controlling electromagnetic emissions from electronic equipment is of great concern in the design of highly sophisticated electronic equipment. The Federal Communications Commission has recently expanded the scope of its rules governing electromagnetic interference emissions from electrical equipment to include computing devices used in the home as well as in commercial, industrial or business environment.

Means for achieving electromagnetic compatibility include shielding, filtering and grounding. Shielding is used to minimize electromagnetic radiation. Filtering the system protects against conducted interference and protects low frequency communication signals by excluding high frequency noise. A proper grounding system is important particularly where there are multiple and electrically different power outlets used within the system. Improper grounding can adversely affect the equipment as well as create potential safety hazards.

Although shielded connectors and filtered connectors have been available for a number of years, there has been a recent increase in demand for these types of connectors and interconnecting devices. Separate shielding means and filtering means are used in many of today's equipment systems.

In addition there has been a demand for means to convert standard connectors into the type that can be used to make a shielded interconnection with a shielded connector and a cable. U.S. Pat. Nos. 4,337,989 and 4,386,814 disclose means for attaining such a conversion.

The filtered shielded connector assembly disclosed herein provides both filtering and shielding capabilities in a single unit, thus eliminating the need for separate devices. Furthermore, the invention provides a means for obtaining a greater number of terminals per given area than is possible with converted standard connectors. The invention also provides a grounding means directly through the connector. The herein disclosed invention provides an economical connector in terms of both space and cost savings.

A filtered shielded connector assembly is comprised of an insulated housing member, a plurality of pin terminals, a filtering means and a shielding means. The housing has a front face having one or more connector receiving openings therein, an oppositely facing back wall with a plurality of apertures therein, oppositely facing side walls, and oppositely facing end walls. The side walls and end walls extend from the front face to the back wall. The housing has one or more connector receiving cavities extending inwardly from said front face toward said back wall.

The shielding means is comprised of two members, a metal front face plate and a metal shell. The face plate has one or more openings therein, the number of openings being equivalent to the number of cavities in the housing. Each opening in the plate has one or more spring fingers which project rearwardly from the plane of the face plate. The metal shell has a rear wall with a plurality of terminal receiving apertures therein, opposing side walls and opposing end walls. The shell rear wall extends between the shell side walls and shell end walls, said walls defining a housing receiving cavity. The face plate and shell are dimensioned to surround the housing member when the assembly parts are joined.

The assembly has a plurality of pin terminals. The terminals have first and second ends, the first end passes through the apertures in the housing back wall and into the connector receiving cavities. The second terminal end extends rearwardly from the housing back wall, passes through a filtering means and the apertures in the shell's rear wall, and extend rearwardly from said shell wall. Fastening means are provided to join the parts of the assembly, thus forming a filtered shielded unit. The spring fingers on the shield face plate extend into the connector receiving cavities to provide shielding continuity with shielded plug connectors.

A better understanding of the invention is obtained by way of example from the following description and the accompanying drawings.

DETAILED DESCRIPTION OF THE INVENTION

Figure 1:
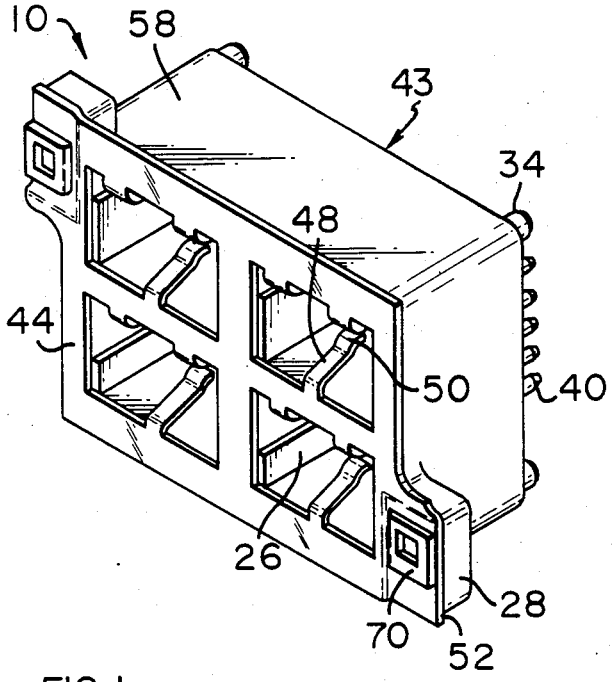
FIG. 1 is an isometric view of the filtered shielded connector assembly disclosed herein.
Figure 2:
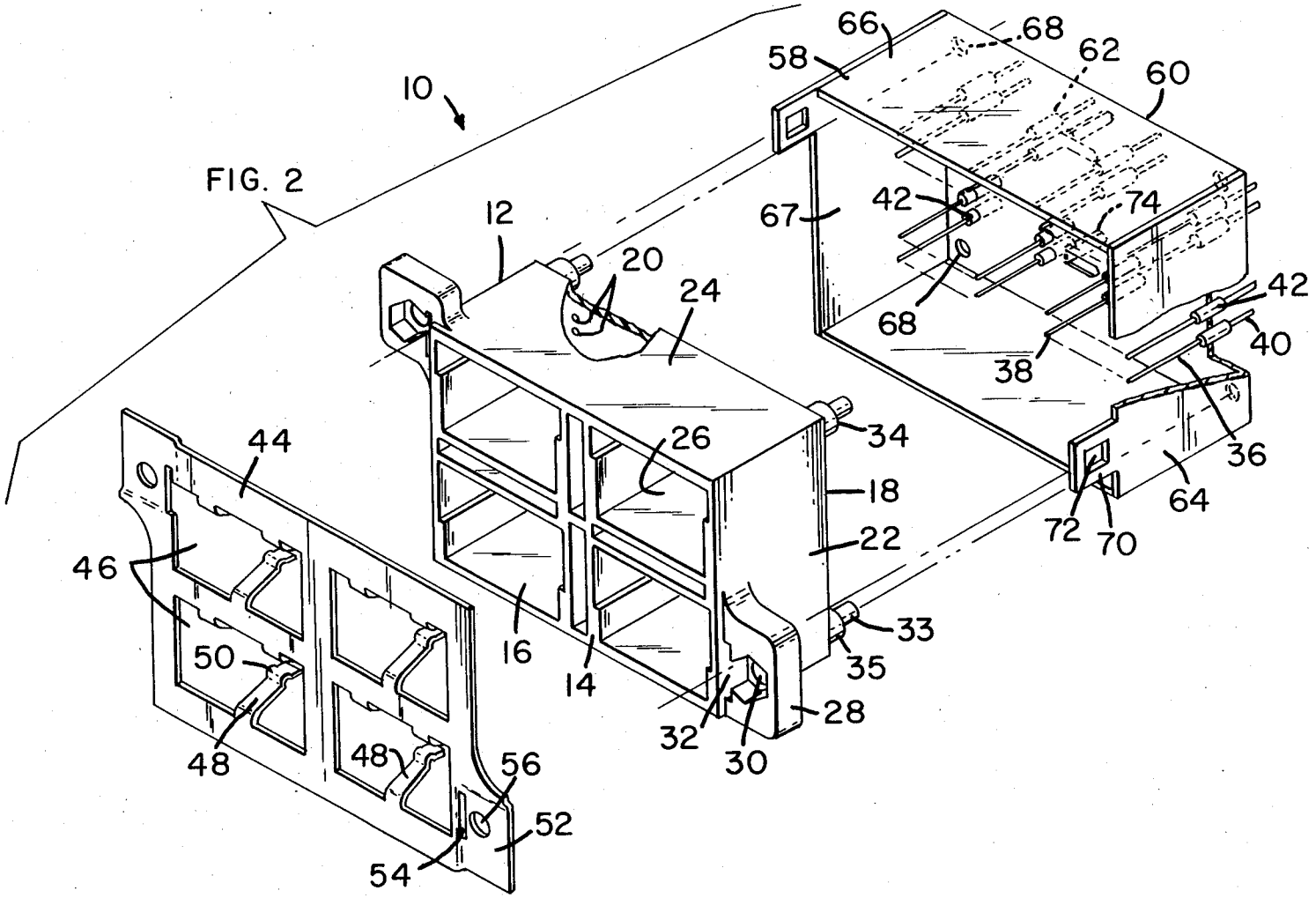
FIG. 2 is an exploded isometric view of the connector assembly of FIG. 1.

Referring now to FIGS. 1 and 2, a filtered shielded connector assembly 10 is comprised of an insulating housing member 12, a plurality of pin terminals 36, a filtering means 42, and shielding means 43. The housing member 12 is comprised of a front face 14 and an oppositely facing back wall 18, oppositely facing side walls 22, and end walls 24. The front face 14 has one or more connector receiving openings 16. The housing 12 contains a plurality of connector receiving cavities 26 which extend from openings 16 in front face 14 inwardly toward the back wall 18. The back wall has a plurality of terminal receiving apertures 20 therein. The back wall further has a plurality of standoff legs 34 extending rearwardly therefrom. Side walls 22 have mounting means 28 extending therefrom.

Figure 5:
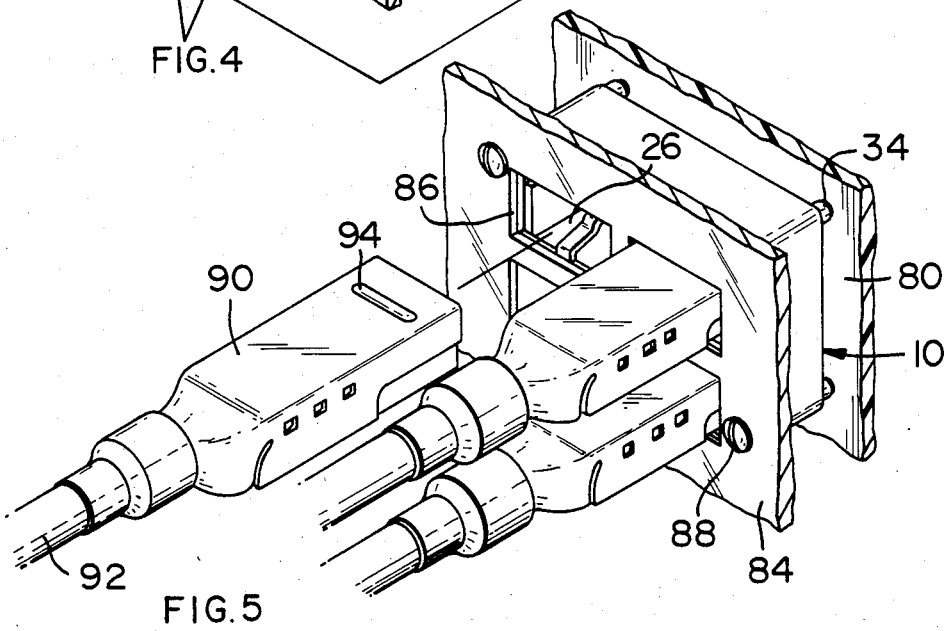
FIG. 5 is an isometric view of the connector assembly of FIG. 1 mated with a plurality of known shielded plug connectors, with one plug connector exploded therefrom.
Figure 6:
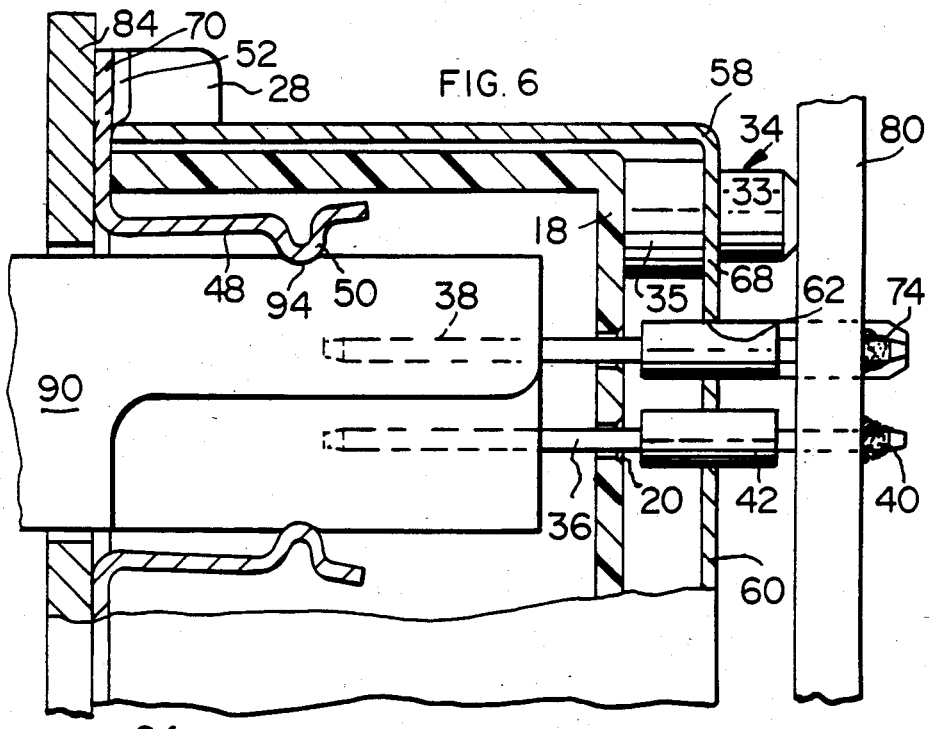
FIG. 6 is a cross-sectional view of one cavity of the assembly of FIG. 5 with a portion of the mating plug therein.

Shielding means 43 is comprised of a face plate 44 and a metal back shell 58. In the preferred embodiment the face plate 44 and back shell 58 are stamped and formed metal. The face plate 44 has one or more openings 46 therein, the number of face plate openings 46 being equivalent to the number of connector receiving openings 16 in front housing face 14. Each face plate opening 46 has one or more spring fingers 48 which extend rearwardly from the plane of plate 14. When plate 44 is joined to housing member 12 these spring fingers 48 extend into the cavities 26 and are used to engage shielded mating plug connectors 90 as shown in FIGS. 5 and 6. Inwardly facing dimples 50 on the spring fingers 48 interconnect with the plug retaining means 94 on the mating connector 90. Referring again to FIGS. 1 and 2 face shield 44 has one or more mounting tabs 52 extending therefrom. These mounting tabs are recessed from the plane of the face plate.

Figure 3:
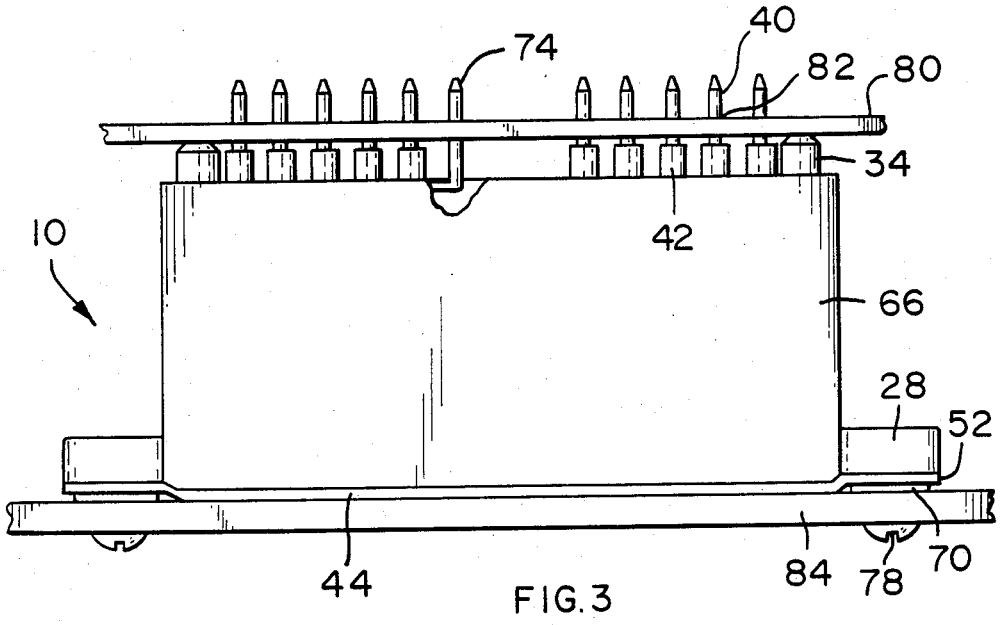
FIG. 3 is a top plan view of the assembly of FIG. 1 mounted to a printed circuit board and panel.

Metal back shell 58 is comprised of a rear wall 60 oppositely facing side walls 64 and end walls 66. These walls 60, 64 and 66 define a housing receiving cavity 67. The rear wall 60 has a plurality of terminal receiving apertures 62 therein. The rear wall 60 also has a plurality of stand-off openings 68 therein. The rear wall 60 further has one or more grounding extensions 74 stamped therein. Extensions 74 extend rearwardly from the rear wall 60 and away from said housing receiving cavity 67. The grounding extensions 74 are offset from the center of the shell to provide polarization for the assembly when it is mounted to a printed circuit board as is shown in FIG. 3.

FIGS. 2 and 6 show that a plurality of pin terminals 36 having a first end 38 and a second end 40 extend through the apertures 20 in the back wall 18 so that first end 38 extends into cavity 26. The second end 40 extends rearwardly from the back wall 18 of the housing 12 and through apertures 62 in rear wall 60 of shell 58. In the preferred embodiment each pin terminal 36 has individual filter sleeves 42 mounted intermediate the ends 38, 40 of the terminals. The filter sleeves 42 extend through apertures 62 in rear wall 60 of shell 58, so that a portion of the filter sleeve 42 extends on each side of wall 60. The filter sleeves are of the type disclosed in U.S. Pat. No. Re. 29258, the disclosure of which is incorporated herein by reference.

When manufacturing the assembly, filter sleeves 42 are mounted on the terminal pins 36. These filtered terminals are inserted through the apertures 62 in the rear wall 60 of the shell 58. Housing 12 is then inserted into the metal shell. The first end 38 of pins 36 are aligned with and inserted into corresponding apertures 20 in the back wall 18 of housing 12. As the parts of the assembly are joined, the standoff legs 34 enter the standoff openings 68 in the rear wall 60 of the shell 58. The standoff legs have enlarged portion 35 which rests against the rear wall 60 of the back shell 58, providing space to protect the portion of filter sleeves 42 that extend into housing receiving cavity 67. The standoff legs 34 have a smaller sized portion 33 which pass through openings 68 and extend outwardly from rear wall 60. As shown in FIGS. 3 and 6, the ends of standoff portions 33 rest on the printed circuit board 80 to provide space for the portions of filters 42 that extend to the rear of the assembly.

Referring again to FIGS. 1 and 2, side walls 64 of back shell 58 have shield fastening extensions 70 extending therefrom. These fastening extensions 70 enter corresponding slots 32 in housing mounting extension 28 and slots 54 in face plate mounting tab 52. After joining the parts, extensions 70 are bent over the recessed mounting tabs 52 on the face plate 44. The tabs 52 are recessed sufficiently so that the fastening extensions 70 lie essentially in the same plane as the face plate 44 as is shown in FIG. 3. Face plate mounting tabs 52, housing mounting extensions 28 and fastening extensions 70 have holes 56, 30 and 72 respectively for mounting assembly 10 to a panel 84 with mounting means 78. Mounting tabs 52 and fastening extensions 70 provide grounding for the assembly when panel 84 is made of a conductive material. FIG. 3 also shows the location of the grounding extension 74' when the assembly is mounted to printed circuit board 80.

The assembly has the capability of being grounded through either the ground extension or through fastening extension 70 and face plate mounting tab 52 if the assembly is mounted to a metal panel.

Figure 4:
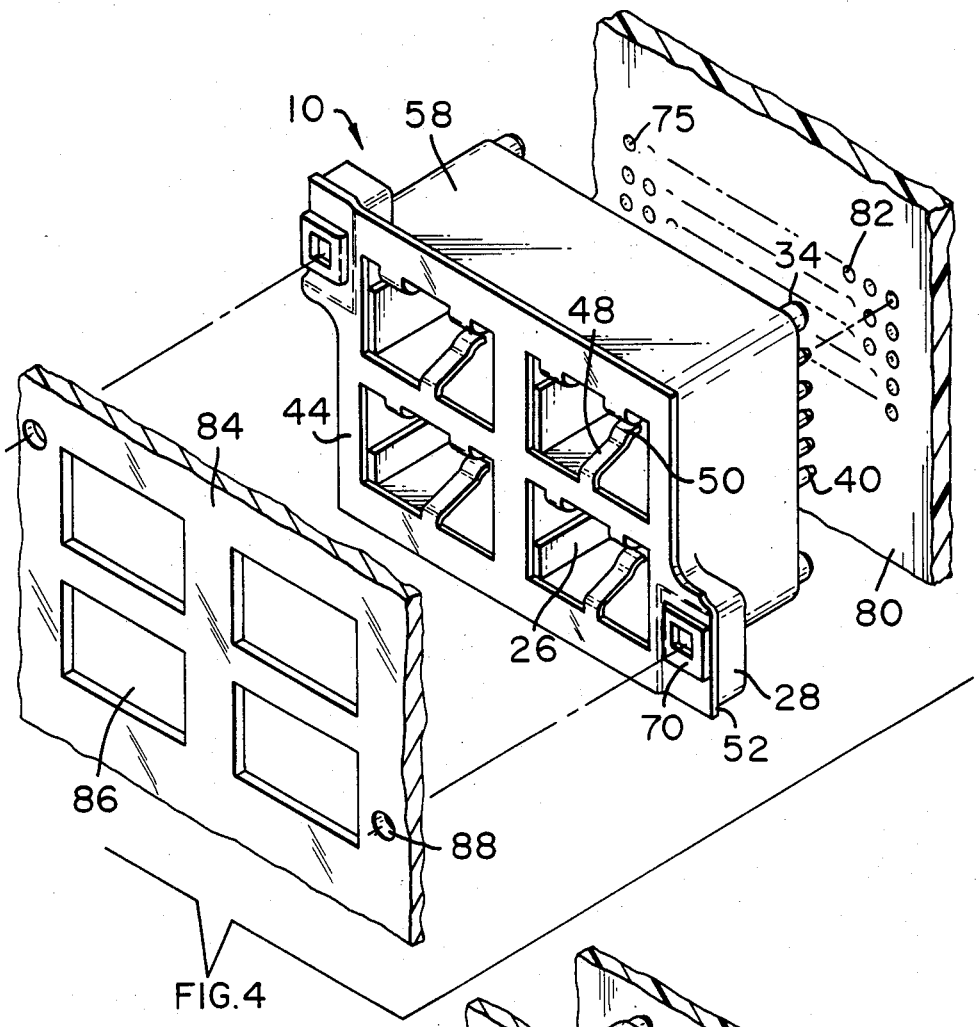
FIG. 4 is an isometric view of the connector assembly of FIG. 1 exploded from a printed circuit board and panel.

FIG. 4 is an exploded view of FIG. 3 which shows assembly 10 exploded from printed circuit board 80 to the rear and panel 84 from the front. Panel 84 has a plurality of connector openings 86 and a plurality of openings 88 for mounting means 78. The pattern of said openings 86 corresponds to that of the assembly 10. In addition to terminal apertures 82, printed circuit board 80 has at least one aperture 75 for ground extension 74.

FIG. 5 shows assembly 10 mounted to printed circuit board 80 and panel 84 mated with a plurality of known shielded plug connectors 90. The mating plug connector 90 is preferably of the type disclosed in U.S. Pat. No. 4,337,989, the disclosure of which is incorporated herein.

Plug connector 90 is connected to shielded cable 92. Connector 90 has at least one plug retaining means 94 which cooperates with dimples 50 in spring fingers 48 to retain plug 90 within cavity 26 as is seen in FIG. 6. Cavities 26 are profiled to provide polarization for the plugs 90.

Figure 7:
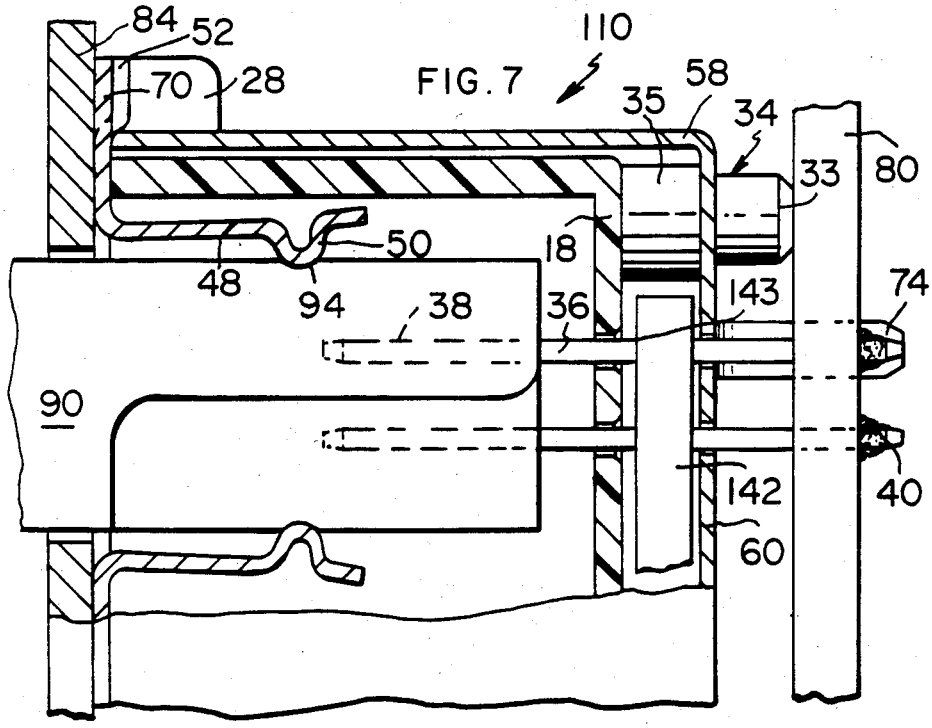
FIG. 7 is a cross-sectional view similar to FIG. 6 showing an alternative embodiment of the herein-disclosed connector assembly.

FIG. 7 is a cross-sectional view of an alternative embodiment of assembly 10. In this embodiment, terminal pins 36 are inserted into a planar filter 142, rather than individual filter sleeves as is shown in FIG. 6. In the alternative embodiment, planar filter 142 is contained between housing back wall 18 and shell rear wall 60. The planar filter 142 has a plurality of apertures for receiving a plurality of terminals 36.

Figure 8:
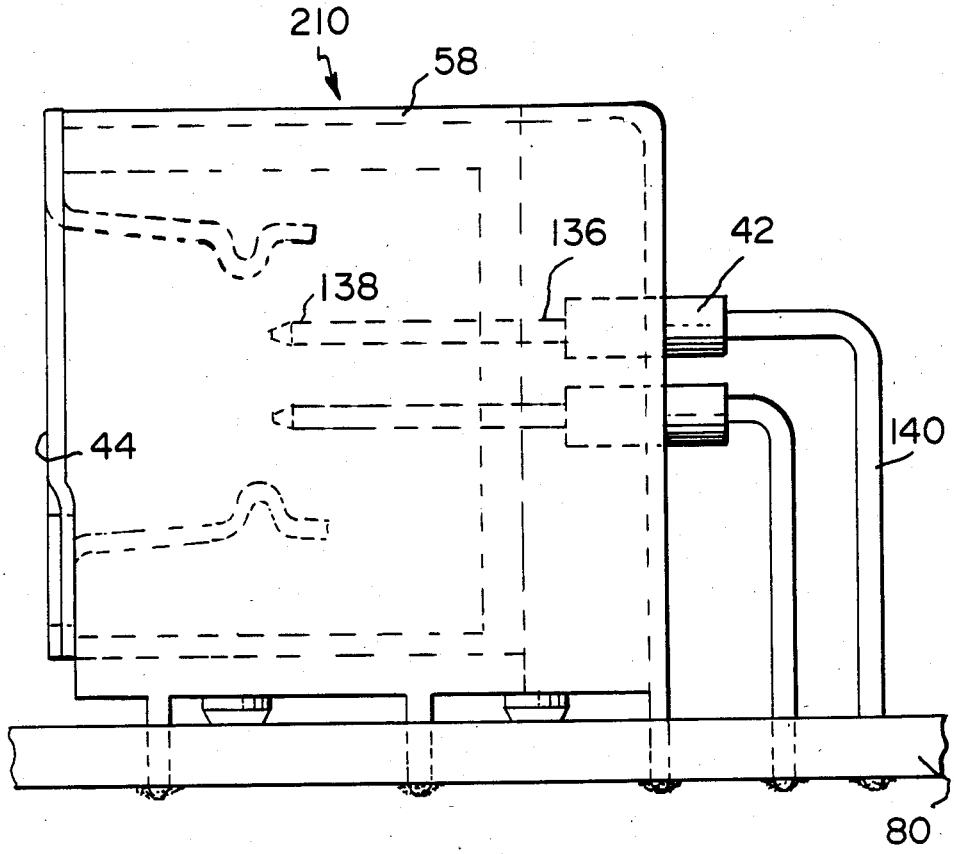
FIG. 8 is a side elevation view of an alternative embodiment of the invention.

FIG. 8 shows a further alternative embodiment in which the filter pins 136 are bent intermediate the second ends 140 for systems requiring right angle mounting.

Figure 9:
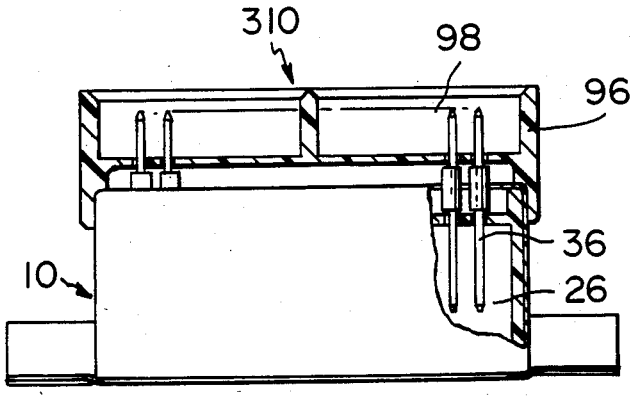
FIG. 9 is a top plan view showing an alternative embodiment of the assembly.

FIG. 9 shows another embodiment 310 of the filtered shielded connector assembly. This embodiment is designed to be mated with plug-type connectors (not shown) instead of being mounted to a printed circuit board. Assembly 310 is comprised of an insulated housing member 96 attached to and extending from the back of filtered shielded connector assembly 10. Housing 96 has at least one plug connector receiving cavity 98 therein. Pin terminals 36 extend from cavity 26 in assembly 10 and into cavity 98.

It is thought that the shielded filter connector assembly of the present invention and many of its attendant advantages will be understood from the foregoing description. It will be apparent that various changes may be made in the form, construction and arrangement of the parts thereof without departing from the spirit or scope of the invention or sacrificing all its material advantages. The form herein described is merely a preferred or exemplary embodiment thereof.

What is claimed is:

1. A filtered and shielded electrical connector, comprising:

dielectric housing means having cavity means therein and rear wall means having apertures extending therethrough;

shield means substantially covering the entirety of said housing means including metal face plate means and metal shell means, said face plate means having opening means corresponding to said cavity means, said shell means having holes in alignment with respective ones of said apertures;

means provided by said shell means and said face plate means securing said shell means and said face plate means together;

electrical filtering means positioned externally of said housing means, said filtering means having holes in alignment with said apertures in said housing means and in alignment with said holes in said metal shell means, said filtering means being electrically commoned to said metal shell means;

electrical terminal means positioned in said apertures and including first section means disposed in said cavity means and second section means extending through said apertures in said housing means, through said holes in said filtering means and through said holes in said shell means; and spring finger means, as part of said face plate means extending into said cavity means, for engagement with shielding means of complementary electrical connector means that is matably connectable with the electrical terminal means.

2. The shielded electrical connector of claim 1 wherein said filtering means are comprised of a plurality of tubular filter sleeves.

3. The shielded electrical connector of claim 1 wherein said filtering means comprises a planar filter member, said planar filter member having a plurality of apertures therein, said filter member apertures being dimensioned thereby receiving the terminal means therein.

4. The shielded electrical connector claim 1 wherein said securing means is comprised of at least one fastening extension extending from said shell means and at least one mounting tab extending from said face plate means, said tab having an opening therein for receiving said fastening extension, said tab being recessed from the plane of said face plate means, said extension being dimensioned to fold over said recessed tab and to lie essentially in the same plane as the front of the face plate means.

5. The shielded electrical connection of claim 1 wherein said shell means has at least one rearwardly projecting grounding extension, said extension being offset from the center of a rear wall of said shell means to polarize the connector.

6. The shielded electrical connector of claim 1 wherein said housing means has a plurality of standoff legs projecting rearwardly from said rear wall means, said standoff legs being dimensioned to provide sufficient space between said rear wall means and a rear wall of said shell means to accommodate said filtering means.

7. The shielded electrical connector of claim 6 wherein said standoff legs further provide space for said filtering means between said rear wall and a printed circuit board to which the connector is mounted.

8. The shielded electrical connector of claim 1 wherein said connector is adapted to receive mating connectors from two sides thereof.

9. A filtered and shielded electrical connector for electrically connecting to a printed circuit board and for electrically connecting a plurality of plug members thereto, the connector comprising:

dielectric housing means having a rear wall means and a plurality of cavities therein defined by endwalls and sidewalls which extend from the rear wall means, each cavity having a plurality of apertures extending through the rear wall;

shield means substantially surrounding the entirety of said housing means including metal shell means and a metal face plate means, said metal shell means having holes in alignment with respective apertures in said housing means, said face plate means having openings therein corresponding to said cavities in said housing means and integral spring finger means for electrically contacting each of said plug members;

electrical filtering means positioned externally of said housing means, said filtering means having holes in alignment with holes in said metal shell means, said filtering means being electrically grounded to said metal shell means;

electrical terminal means positioned in said apertures and including first section means disposed in said cavities defining discreet arrays of pins for interconnection with a matable plug, and second section means extending through said aperture in said housing means, through said holes in said filtering means and through said holes in said shell means; and means to common said metal shell means to grounding traces on the printed circuit board.

10. The connector of claim 9 wherein the metal shell means is stamped and formed from a flat metal blank, to define a rear wall and sidewalls.

11. The connector of claim 10 wherein the means to common the connector metal shell means to grounding traces on the printed circuit board comprises a tab struck out from said rear wall of said metal shell means.

12. The connector of claim 9 wherein the filtering means are tubular members mounted over the terminal means extending from an interior position outside of said dielectric housing and inside of said shell means, to an exterior position outside of said metal shell means.

13. The connector of claim 12 further comprising means to space the connector and the filter away from the printed circuit board.

14. The connector of claim 13 wherein the spacing means comprise boss members extending from the dielectric housing back wall and through the rear wall of said metal shell means a distance greater than the extension of the filters.

* * * * *